United States Patent [19]

Lockard

[11] Patent Number: 4,697,053

[45] Date of Patent: Sep. 29, 1987

[54] ROCKER SWITCH

[75] Inventor: Joseph L. Lockard, Harrisburg, Pa.

[73] Assignee: AMP Incorporated, Harrisburg, Pa.

[21] Appl. No.: 842,604

[22] Filed: Mar. 21, 1986

[51] Int. Cl.[4] ..... H01H 5/08

[52] U.S. Cl. ..... 200/68.2; 200/303; 200/339; 200/6 BA

[58] Field of Search ..... 200/68.2, 339, 6 BA, 200/68.1, 68.3, 303

[56] References Cited

U.S. PATENT DOCUMENTS

| | | | |
|---|---|---|---|
| 3,944,768 | 3/1976 | Aryamane et al. | 200/68.2 |
| 3,989,915 | 11/1976 | Nishikawa | 200/68.2 |
| 4,417,106 | 11/1983 | Gingerich et al. | 200/5 R |
| 4,571,467 | 2/1986 | Sorenson et al. | 200/6 BA |
| 4,590,344 | 5/1986 | Kikta et al. | 200/291 |

FOREIGN PATENT DOCUMENTS

| | | | |
|---|---|---|---|
| 695205 | 9/1964 | Canada | 200/68.2 |
| 93327 | 11/1983 | European Pat. Off. | 200/303 |
| 669110 | 11/1929 | France | 200/68.2 |
| 409645 | 5/1934 | United Kingdom | 200/339 |

*Primary Examiner*—Henry J. Recla
*Assistant Examiner*—Renee S. Luebke
*Attorney, Agent, or Firm*—Anton P. Ness

[57] ABSTRACT

A rocker switch has within a housing, a two-position actuator which moves a spring-loaded plunger from a first position to a second position of engagement with a bar, moving the bar over a fulcrum and wedging a second conductive end of the bar into bridging engagement between a second pair of spring contact terminals while simultaneously forcing the first conductive end out of engagement with a first pair of terminals. During moving from the first position to the second position the plunger disengages from contact with the bar at a first position proximate a first end of the bar and rides over a peaked camming surface which substantially compresses the spring while the bar remains stationary, bridging the first pair of terminals. When the plunger reaches the peak of the camming surface, the plunger is released to impact on the bar at a second position proximate the second end of the bar, suddenly forcing the second end downward into bridging the second pair of terminals. The bar may be a metal mass to perform as a heat sink. The terminals may be mounted in a contact assembly which also pins the bar in a pivotable state against the fulcrum. A latching system is disclosed which allows pivotal movement of the actuator within the housing.

23 Claims, 9 Drawing Figures

ROCKER SWITCH

FIELD OF THE INVENTION

The present invention relates to the field of electrical switches and more particularly to bistable switches.

BACKGROUND OF THE INVENTION

Switches are known which are actuatable between a first position and a second position. Such switches, especially for low current loads and voltage levels, can comprise a snap action member which is bistable, that is, having a first stable position electrically engaging a first stationary contact, and a second stable position electrically engaging a second stationary contact. In one type, a snap action member stresses itself against one or the other of the stationary contact members with contact normal force, and an actuator stresses the snap action member during actuation coincidentally reducing the existing contact normal force of the member against an initial one of the contacts, until the flex point is reached at which the member flexes or snaps from its initial or first stable position to its resulting or second stable position. In another type, as disclosed in U.S. Pat. No. 4,417,106 a spring-loaded actuator is used with a seesaw movable contact whose center point rests on a fulcrum, the actuator providing the source of the contact normal force of a first end of the movable contact against a first stationary contact; the actuator is moved along the movable contact and over the center point thereof, removing the force against the first end, and snapping against the second end of the movable contact to urge it against a second stationary contact under contact normal force.

However, such snap action is not truly instantaneous but instead is comprised of a short period of snapping preceded by a very short period of disengagement from the first contact, and followed by an even shorter period of becoming engaged with the second contact. It is known that the longer the time it takes the snap action member or movable contact member to disengage, the more likelihood and extent of damage to the contact surfaces by reason of the reduction of contact normal force between the contact surfaces during that time. Such reduced contact normal force is known to reduce the real area of contact between the metal surfaces which microscopically comprises facing densely packed arrays of structures known as asperites, having varying heights; at a reduced contact normal force fewer and fewer asperites (the higher ones) engage each other and they continue carrying the electrical load originally carried by all. Such relative increase in the load on the last remaining asperites before complete disengagement results in points of constriction resistance and highly localized heating and melting due to current, and after complete separation electrical arcing with vaporization and burning due to voltage. Some prior switches sought to minimize damage to contacts by using buttons of a erosion-resistant precious metal alloy which served as local heat sinks but provide limited contact surface area. Such buttons are secured firmly on ends of spring arms made of a metal alloy selected for its spring properties but having reduced electrical conductivity, and the structure of the spring arms has low mass for speed of snapping and therefore has limited current-carrying and heat sinking capability.

At best the prior art switches are compromises between seemingly contradictory goals.

It is desirable to provide a switch which not only has a very short period of engagement, but which also shortens the period of disengagement from the initial contact and also retains the full contact normal force for as long as possible. It is also desirable to eliminate the need for expensive precious metal alloys by minimizing the causes of erosion. It is also desirable to provide a large mass for heat dissipation. It is still further desirable to provide a switch which is easy to assemble, and easy to mount to a panel. In general, it is desirable to provide an economical and durable switch for mid-range current and voltage loads.

SUMMARY OF THE INVENTION

The present invention includes a pivotable actuator assembly in one end of a housing, a contact assembly in the other end having first and second pairs of contact sections and a bar with conductive ends pivotable about a fulcrum by the actuator assembly between the first and second contact sections to electrically bridge one or the other as desired. The actuator assembly includes a plunger which is spring loaded during the first half of actuating movement and which is released to strike the bar by reason of the release of the stored energy to rock the bar over the fulcrum, instantaneously forcing the impacted end to be wedged between its pair of contact sections, while the other end of the bar is simultaneously forced out of its wedged position between the other pair of contact sections.

According to another aspect of the present invention the bar may be a solid mass to serve as a heat sink, such as being solid copper.

According to yet another aspect of the present invention one of each pair of terminals is molded into a hermaphroditic contact section. Two such contact inserts are securable together to form a contact assembly which is mountable in the housing. The bar may be pivotably secured to the contact assembly by being pinned by bosses which join above the center of the bar and against a fulcrum formed beneath the center of the bar by peaked sections of the joined inserts. Portions of the contact assembly may extend along both sides of the bar and also above the central portion of the bar in a pair of aligned gently sloped peaks whose sides serve as camming surfaces for the plunger during actuating movement to urge the plunger upward and compress a spring, loading the plunger.

According to still another aspect of the invention, the actuator member is mounted to the housing so that it is pivotably held therein, by latching around opposing cylindrical bosses extending inward from sides of the housing at the actuating end of the housing and defining an axis of rotation. The latching and mounting can be accomplished by the actuator having an arcuate flange above each boss and an arcuate bearing surface on a free end of a latch arm extending toward the boss from a joint near the bottom of the actuator and which latch arm rides over the boss during mounting and latches thereunder.

It is an object of the present invention to provide a rocker switch for switching mid-range current loads such as those carried by 14- to 18-gage wire.

It is another object of the present invention to provide a heat sink means for a rocker switch.

It is yet another object of the invention to make the transition of one switch state to another as rapidly as possible, and thus minimize damage to the contact materials due to arcing, highly localized heating, and subsequent melting and vaporization from the switching of electrical loads.

It is still another object of the invention to utilize terminals not requiring contact buttons of expensive alloys but providing large contact area, appropriate contact normal force, good heat sinking at the contact interface and large air gaps between the terminals.

DETAILED DESCRIPTION OF THE PREFERRED EMBODIMENT

Figure 1:
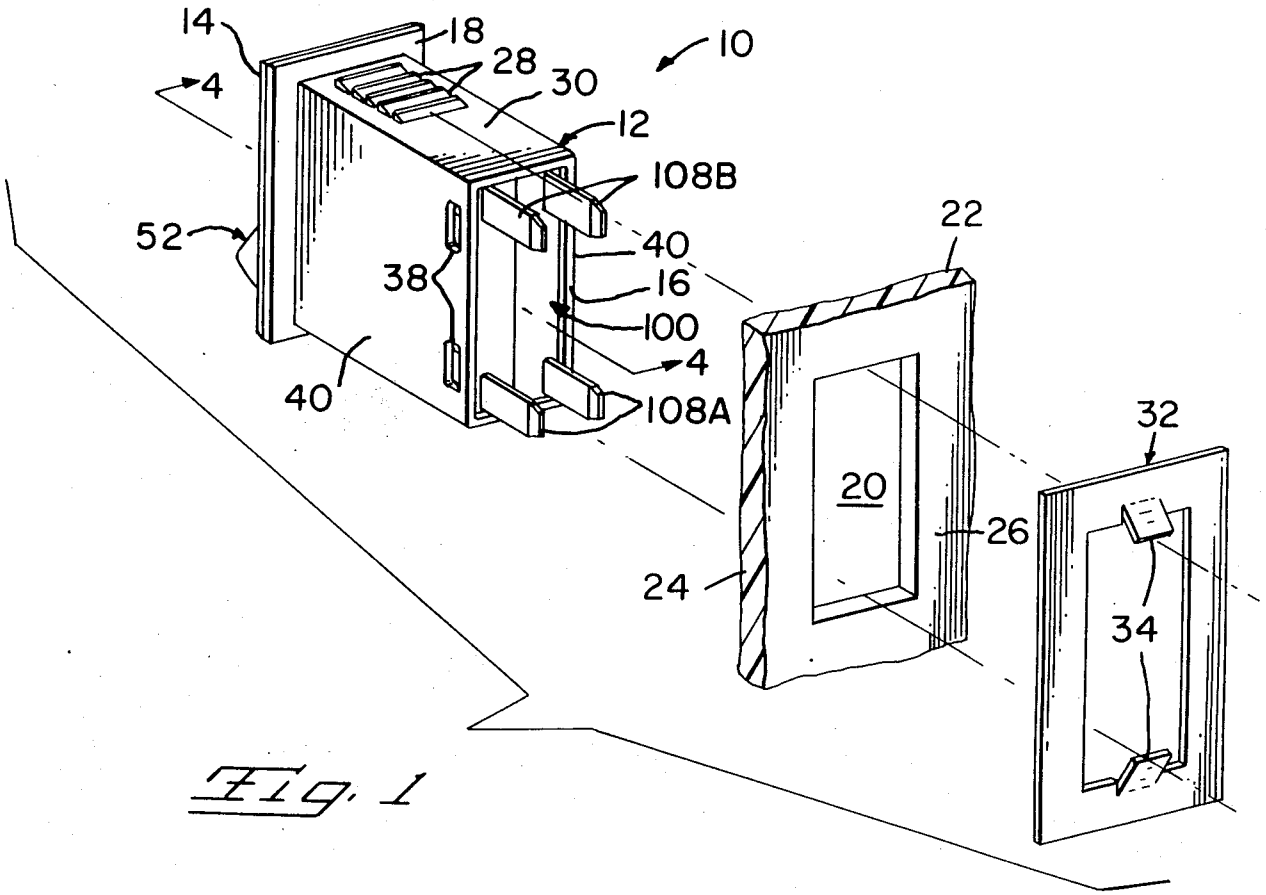
FIG. 1 is a perspective view of the rocker switch of the present invention mountable to a panel by a spring clip.

Rocker switch 10 in FIG. 1 includes a shell-like housing 12 within which are secured an actuator assembly and a contact assembly 100, with actuator 52 secured at a first or actuating face 14 of housing 12 and contact assembly 100 secured at the second or contact face 16 of housing 12. Contact assembly 100 has pairs of blade-like outer contact sections 108A,108B extending axially outwardly from contact face 16 for electrical engagement with corresponding contact sections of an electrical receptable (not shown).

Figure 4:
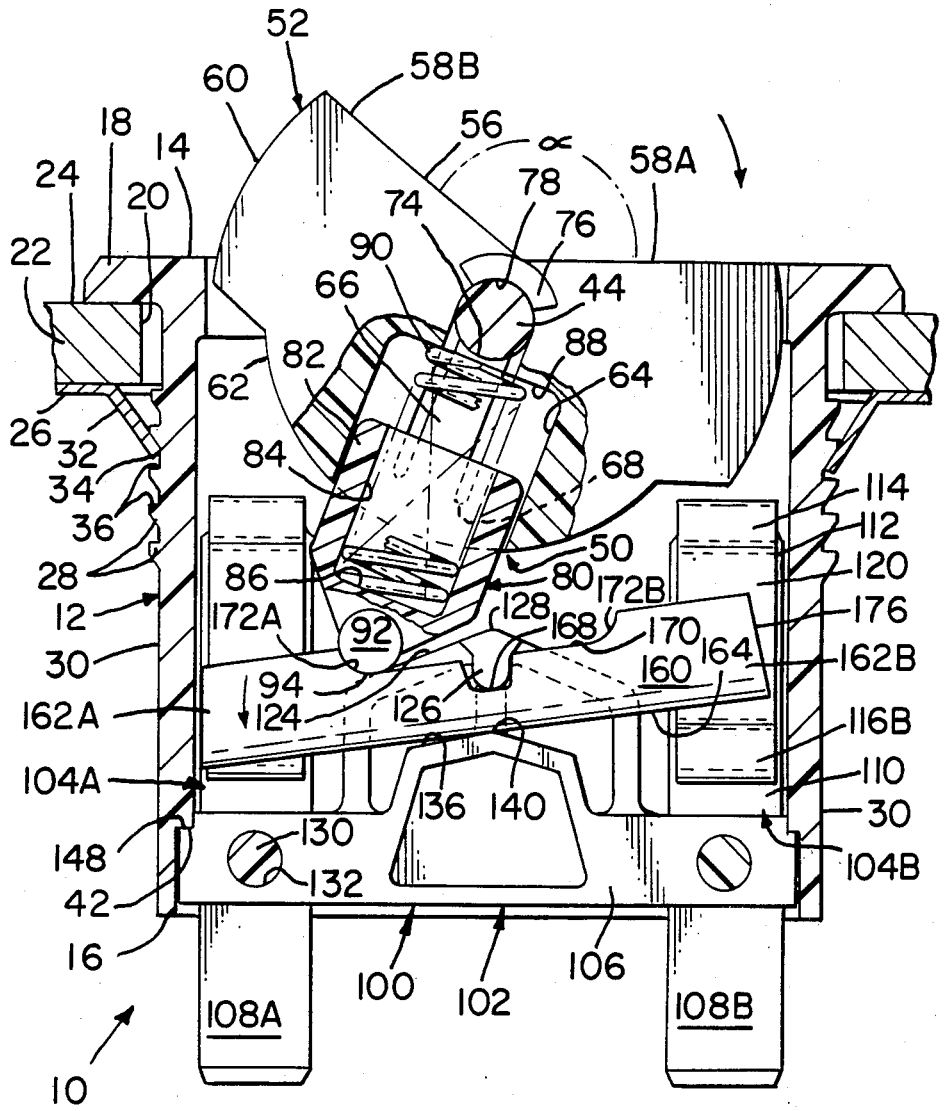
FIGS. 4 to 6 are longitudinal section views taken generally along line 4—4 of FIG. 1 showing the actuation of the switch.

Housing 12 is mountable in an aperture of a panel and has a peripheral flange 18 at actuating face 14. As shown in FIGS. 1 and 4, rocker switch 10 is insertable through aperture 20 of panel 22 from an outer side 24 thereof, with flange 18 stopping against outer side 24 around aperture 20. Actuator 52 is accessible on outer side 24 of panel 22, and the remainder of switch 10 is disposed on the inner side 26 of panel 22 with blades 108A,108B extending axially inwardly from rocker switch 10. Switch 10 is held to panel 22 preferably by means of an array of ratchet-like ribs 28 on opposing sides 30 of housing 12 in cooperation with a pair of lances 34 of a spring clip 32 against inner side 26 of panel 22: ends of lances 34 engage stop surfaces 36 of a respective pair of ribs 28 to resist axially rearward movement of switch 10 with respect to panel 22. The array of ribs allows compensation for varying thicknesses of panels. Housing 12 is preferably molded of a thermoplastic dielectric material such as glass-filled polyester.

Figure 2:
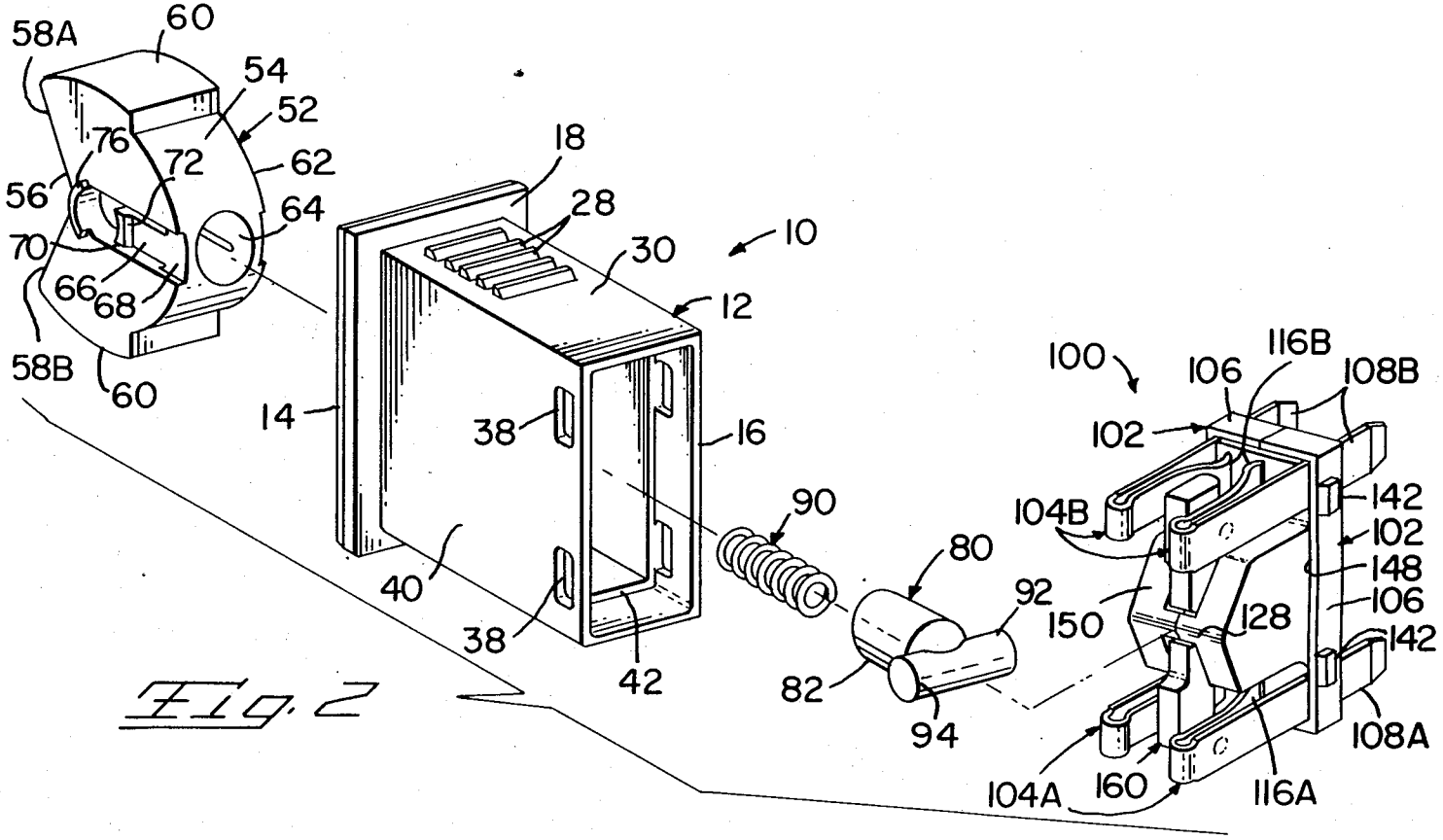
FIG. 2 is an exploded view of the switch showing the contact assembly, and the actuator, spring and plunger of the actuator assembly.

FIG. 2 shows actuator 52, compression spring 90 and plunger 80 which together comprise the actuator assembly. Contact assembly 100 is shown having pairs of terminals 104A,104B having terminal blades 108A,108B. A bar 160 is held in contact assembly 100 and is pivotable by plunger 80 as will be later explained, and has ends 162A,162B (FIG. 3) which are conductive to bridge electrically between either the pair of contact sections 116A or the pair of contact sections 116B as desired, when switch 10 is in service. Contact assembly 100 is mounted in housing 12 preferably by latches 142 in apertures 38 on sides 40 of housing 12, after which potting material is preferably placed in apertures 38 and also along contact face 16 about the seam between contact assembly 100 and housing 12.

Figure 3:
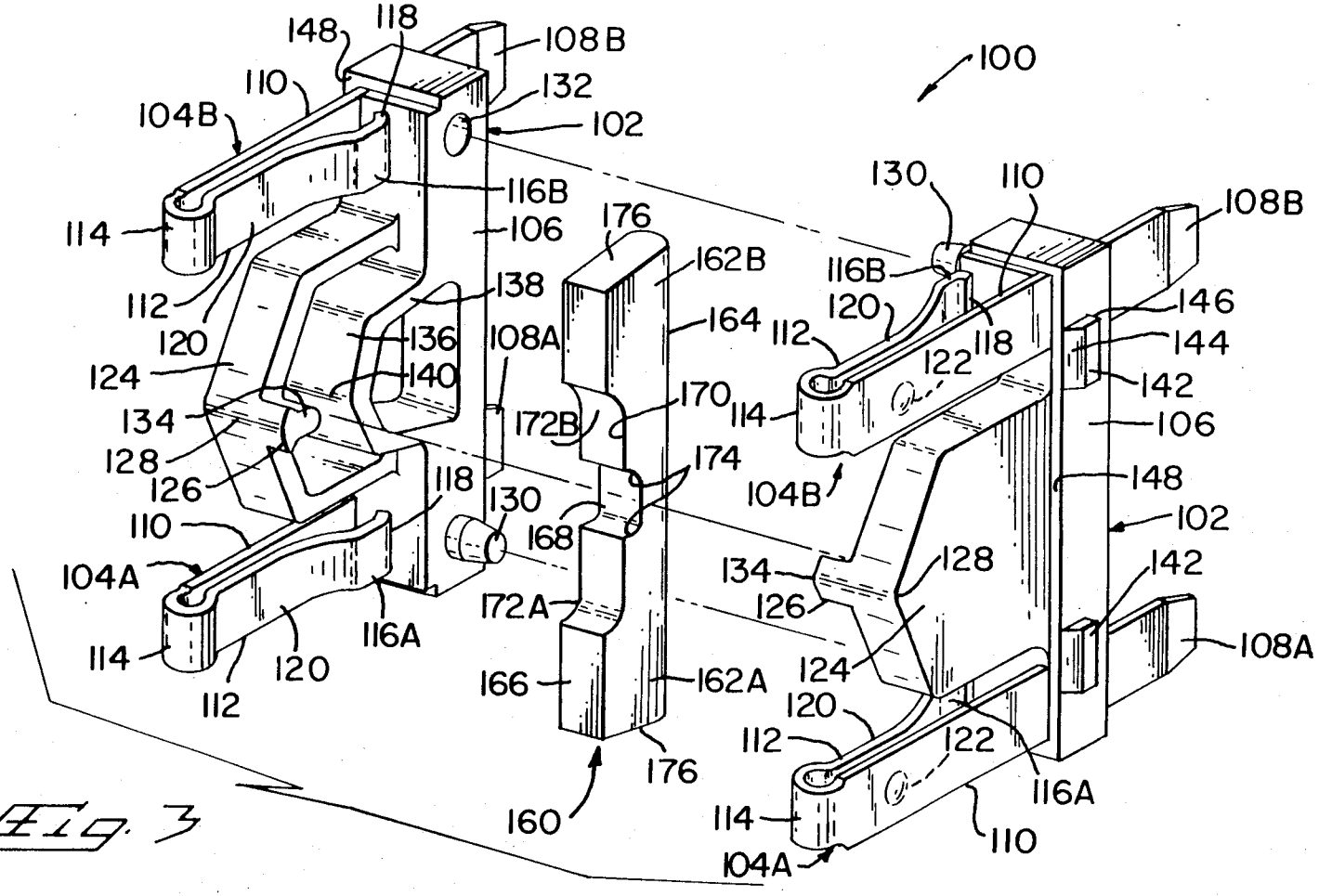
FIG. 3 shows the contact inserts and bar comprising the contact assembly.
Figure 7:
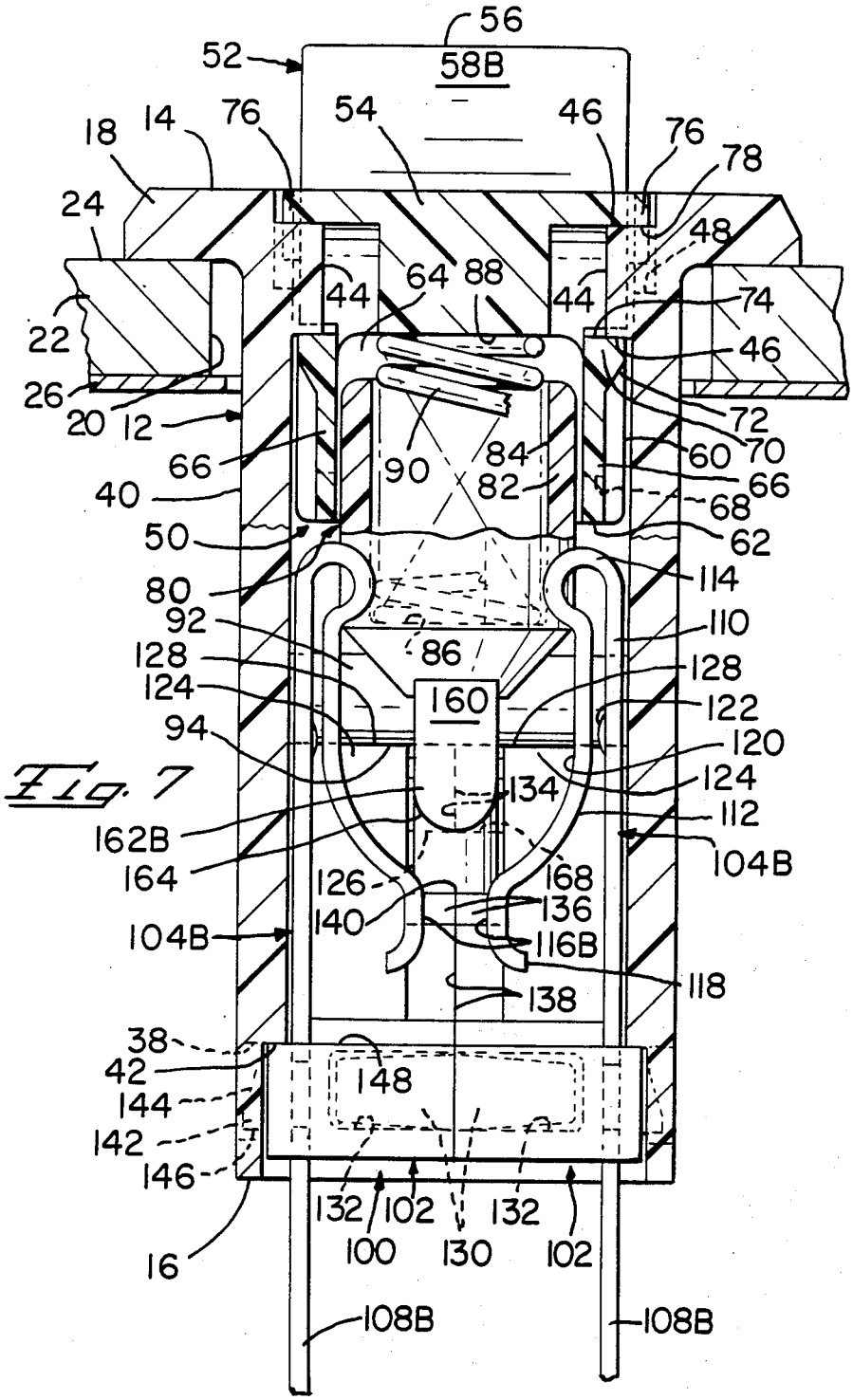
FIG. 7 is an enlarged cross-sectional view taken along line 7—7 of FIG. 5.

With reference to FIGS. 3 and 7, contact assembly 100 preferably comprises a pair of hermaphroditic contact inserts 102 which are secured together to trap bar 160 therebetween. Each contact insert 102 preferably comprises two identical terminals 104A,104B which are held in a mold for a dielectric insert body 106 to be molded therearound of a thermoplastic material such as glass-filled polyester such that the terminals extend through a base portion of body 106. The terminals are preferably stamped and formed of brass while bar 160 is preferably a solid profiled mass of copper, or of copper alloy or other metal having desirable current-carrying ability. Terminals 104A,104B each have a blade 108A or 108B, a body section 110, a spring contact arm 112 bent to double back along and almost against body section 110 from a bight 114, with a contact section 116A or 116B proximate the free end 118. Each spring contact arm 112 has a recessed central section 120 disposed adjacent a small depression 122 which preferably extends inwardly from body section 110, best seen in FIG. 7, to support spring contact arm 112 upon outward stressing thereof by bar 160. Extending upwardly from the base portion of each insert body 106 between terminals 104A,104B is an outer peaked section 124 with an inwardly directed boss 126 at the peak 128 thereof. An inwardly-directed securing projection 130 is disposed proximate one end of insert body 106 and a projection-receiving hole 132 is disposed proximate the other end. Securing projections 130 of two such contact inserts 102 are dimensioned to be tightly received in the corresponding holes 132 so that inserts 102 are secured together by projections 130 being in interference fit at least proximate the entrances to holes 132.

In FIGS. 3 and 4, bar 160 has first and second ends 162A,162B respectively to be associated with pairs of terminals 104A,104B respectively upon assembly. Bottom surface 164 is preferably rounded to facilitate engaging and disengaging from contact sections 116A,116B. Top surface 166 is profiled, having a pinning recess 168 centrally thereof and a shallow recess 170 extending from pinning recess 168 towards first and second ends 162A,162B and containing a first engaging surface 172A proximate first end 162A and a second engaging surface 172B proximate second end 162B.

When the two hermaphroditic contact inserts 102 are fitted together with bar 160 therebetween, bosses 126 of each insert just meet each other at their inwardly directed surface 134 above bar 160. Inner peaked sections 136 of the contact inserts 102 just meet at their inside peripheral surface 138 to form a structure to support bar 160, the structure having a peak to form a fulcrum 140. Joined surfaces of contact inserts 102 may be bonded by a compatible adhesive, if desired. Thus bar 160 is pinned at pinning recess 168 between joined bosses 126 thereabove and fulcrum 140 therebelow. Contact assembly 100 thus formed also has a pair of latches 142 along each side, latches 142 each having a taper or bevel 144 to facilitate entry into housing 12 and a stop surface 146 to latch in a corresponding aperture 38 of housing 12.

Contact assembly 100 also has stop shoulder 148 to engage corresponding ledges 42 within housing 12 as shown in FIG. 7 to stop movement of contact assembly 100 inwardly into housing 12 during assembly.

Figure 5:
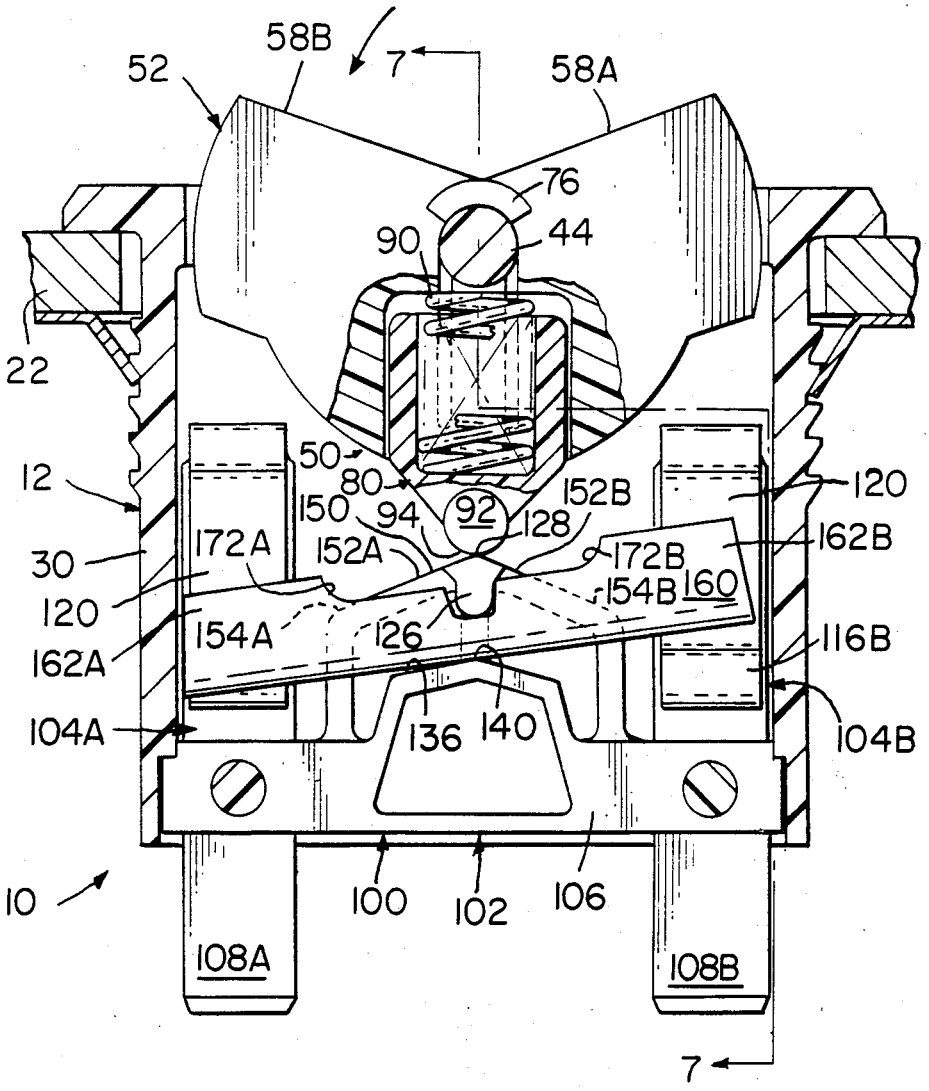
Figure 6:
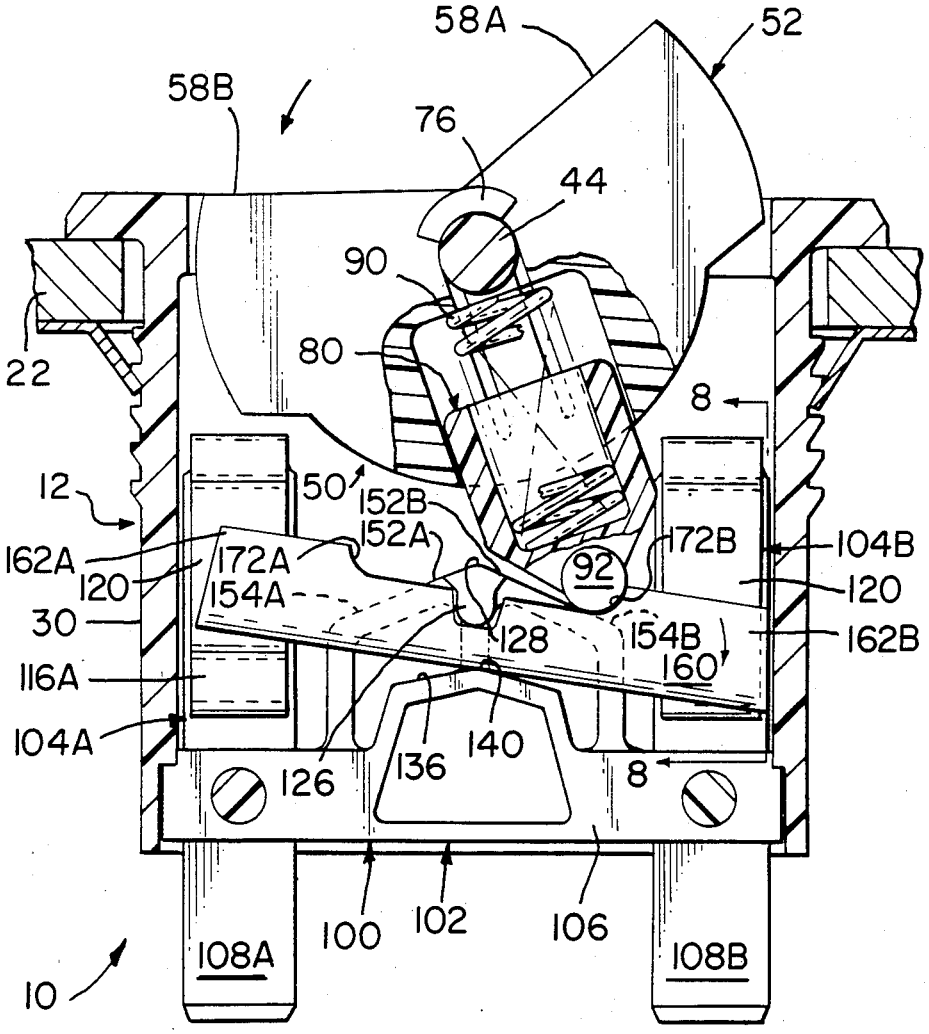

Actuator 52 is preferably molded of thermoplastic material such as unfilled polyester. As shown in FIGS. 2, 4 and 7 actuator 52 has a body section 54 generally having a top or actuator end 56 comprised of two push surfaces 58A,58B disposed at an angle $\alpha$ which may be about 150°. Side surfaces 60 are gently rounded for clearance capability with the inside surfaces of housing walls 30 during insertion and actuation. The surface of bottom end 62 is reduced and is also rounded for clearance purposes with regard to bights 114 of terminals 104A,104B, as seen in FIGS. 4 to 6. Central cavity 64 extends upwardly into body section 54 from bottom end 62 to receive compression spring 90 and plunger 80 thereinto when switch 10 is in an assembled condition. Plunger 80 is movable along and spring 90 compressible along an axis of movement defined by the walls of central cavity 64.

Figure 9:
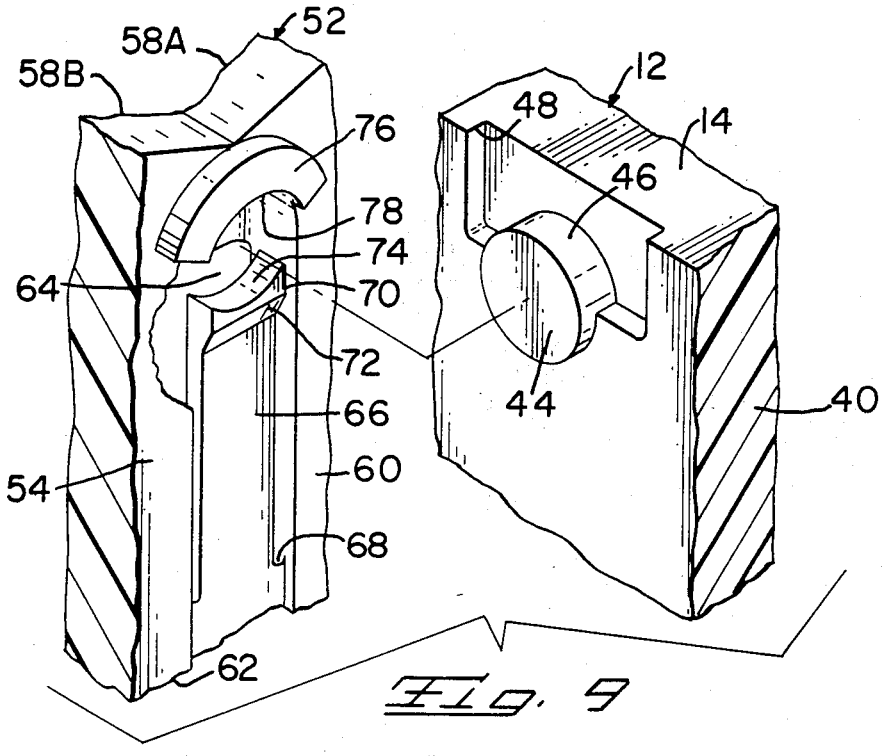
FIG. 9 is an enlarged view of the mechanism for mounting the actuator in the switch housing allowing pivotal rocking of the actuator.

Actuator 52 is preferably pivotably mounted to housing 12 in the following manner, as best shown in FIGS. 7 and 9. Cylindrical bosses 44 extend inwardly from opposed interior surfaces of housing walls 40 proximate actuating face 14 and define an axis of rotation. A pair of latches 66 extend along sides of central cavity 64 from latch joints 68 proximate bottom surface 62. Latches 66 are resiliently deflectable inwardly during assembly of actuator 52 into housing 12. Proximate free ends 70 thereof are bevels or tapers 72 to ride over cylindrical bosses 44 extending inwardly from respective interior surfaces of walls 40 of housing 12 proximate actuating face 14 thereof. Upon assembly of actuator 52 into housing 12, free ends 70 resile to latch actuator 52 in housing 12; the top surface thereof are concave to complement the cylindrical nature of bosses 44 and act as bearing surfaces 74 against which bearing surfaces 46 of bosses 44 engage. Referring to FIG. 9, opposed from bearing surfaces 74 are arcuate flanges 76 extending outwardly from the sides of actuator 52 to pin the bosses 44 between respective arcuate flanges 76 and free latch ends 70. Concave bearing surfaces 78 of arcuate flanges 76 bear against bearing surfaces 46 of cylindrical bosses 44 for pivotable movement of actuator 52 during actuating thereof. Recesses 48 are disposed in the interior surfaces of walls 40 about bosses 44 and provide clearance for movement of arcuate flanges 76 therein about bosses 44. Actuator 52 with push surfaces 58A,58B has a low profile but may also include a toggle structure, if desired.

Referring now to FIGS. 2, 4 and 7 switch 10 can be assembled by inserting actuator 52 into actuating face 14 of housing 12 until latched by means of cylindrical bosses 44 being pinned between respective flanges 76 and free latch ends 70 of latches 66. Compression spring 90 is then inserted into central cavity 64 of actuator 52 against cavity bottom 88, and plunger 80 is inserted into central cavity 64 over spring 90 (completing actuator assembly 50). Finally, contact assembly 100 is latchably inserted into contact face 16 of housing 12 and against plunger 80.

Plunger 80 comprises a tubular body section 82, a central cavity 84 extending inwardly from a top surface of plunger 80 and having a cavity bottom 86 opposed from cavity bottom 88 of actuator cavity 64. Compression spring 90 is disposed between cavity bottom 86 of plunger 80 and cavity bottom 88 of actuator 52 and compressible therebetween. At the base of body section 82 and joined integrally thereto or preferably formed integrally therewith is impactor 92 oriented cross-wise within housing 12 with respect to bar 160 between and spaced from opposing housing walls 40. Dielectric plunger 80 is preferably molded from a thermoplastic material such as unfilled polyester. Compression spring 90 is preferably a coil of stainless steel or alternatively of beryllium copper, and having a compression strength of for example, three pounds. It can be seen that plunger body section 82 has an outer diameter slightly less than the inside diameter of actuator cavity 64 and is able to be moved axially within cavity 64. Plunger body section 82 preferably has an elliptical outer cross-sectional shape to correspond to the preferred elliptical cross-section shape of actuator cavity 64, which maintains plunger 80 against rotation and thus keeps impactor 92 cross-wise with respect to bar 160. Plunger body section 82 serves to back up latches 66 to minimize the possibility of delatching after assembly especially during actuating movement of actuator 52 when plunger 80 is farther within central cavity 64 as seen in FIG. 5 and axial stress is conveyed to latches 66 by loading of spring 90.

Figure 8:
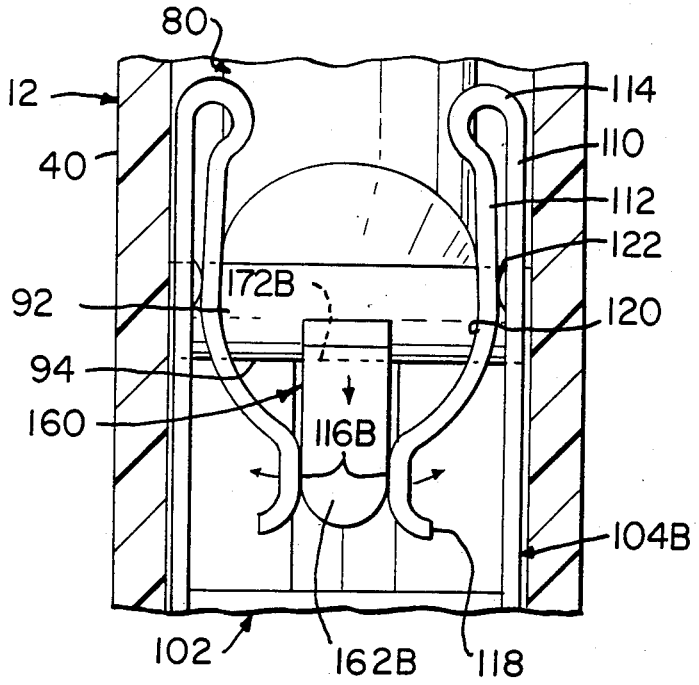
FIG. 8 is an enlarged part cross-sectional view taken along line 8—8 of FIG. 6.

The action of the rocker switch being actuated from a first position to a second position is demonstrated by FIGS. 4 to 6. FIG. 7 illustrates the second pair of terminals 104B unengaged by end 162B of bar 160, and FIG. 8 illustrates terminals 104B in an electrically bridged condition, with bar end 162B wedged between contact sections 116B urging spring contact arms 112 outwardly and against depressions 122. Actuator assembly 50 is illustrated in an initial position in FIG. 4, with push surface 58A of actuator 52 in its lowered actuated position flush with actuating face 14 of housing 12; impactor 92 engages bar 160 in an initial engaging position adjacent first engaging surface 172A thereof; and first end 162A of bar 160 is disposed in electrical engagement with and bridging contact sections 116A of terminals 104A, while second end 162B is unengaged with contact sections 116B of terminals 104B and is disposed in free space between the recessed central sections 120 of spring contact arms 112 thereof.

Best seen in FIG. 5, outer peaked sections 124 of joined contact inserts 102 have aligned top surfaces 150 including aligned peaks 128. Sloping toward terminals 104A and more particularly toward first engaging position 172A of bar 160, are coplanar camming surfaces 152A, one on each insert 102; correspondingly, coplanar camming surfaces 152B thereof slope toward terminals 104B and second engaging position 172B of bar 160. The relationship of camming surfaces 152A,152B and first and second engaging positions 172A,172B is such that bearing surface 94 of impactor 92 engages bar 160 at two spaced locations (172A,172B) only, and between those positions engages the camming surfaces 152A,152B and peak 128 of top surface 150 of outer peaked section 124. Thus, outer sections 154A and 154B of camming surfaces 152A,152B extend further from actuator assembly 50 and its axis of rotation at cylindrical bosses 44, than do first and second engaging positions 172A and 172B on top surface 166 of bar 160. The distance between outer peaked sections 124 of joined contact inserts 102 is greater than the width of bar 160 to allow pivotable movement of bar 160 about fulcrum 140. Impactor 92 is appropriately oriented and is long enough to straddle the distance to be atop both outer peaked sections 124 simultaneously.

In FIG. 5 push surface 58B of actuator 52 is being depressed and has been moved about half-way through the actuation cycle. Impactor 92 of plunger 80 has climbed camming surface 152A which urges plunger 80 upward into cavity 64 of actuator 52 and compresses spring 90 between cavity bottom 88 of actuator 52 and cavity bottom 86 of plunger 80, thus storing energy and significantly loading plunger 80. Impactor 92 moves out of engagement with bar 160; bar 160 remains in its bridging position held under contact normal force between the pair of contact sections 116A disposed on free ends 118 of spring contact arms 112 of terminals 104A, with spring contact arms 112 being in a stressed state by being wedged apart by bar 160.

Referring to FIGS. 5 and 6, as impactor 92 rides over peak 128 of outer peaked section 124, plunger 80 is in a substantially loaded state; and it then begins a forceful uncontrolled descent. Compressed spring 90 releases much of its energy, and plunger 80 is in rapid motion when impactor 92 encounters and impacts with bar 160 proximate second engaging surface 172B. The resulting impact rocks bar 160 over fulcrum 140, and forces second end 162B downward wedging it between contact sections 116B on free ends 118 of terminals 104B bridging the pair of terminals 104B, while the electrical connection between the pair of terminals 104A is instantaneously broken when first end 162A of bar 160 is correspondingly moved upward out of engagement with terminals 104B and into the free space between recessed central sections 120 of spring contact arms 112 of terminals 104A. Sides 174 of pinning recess 168 of bar 160 are sloped to allow bar 160 to be rocked about joined bosses 126; and end surfaces 176 of bar 160 are angled to clear the housing walls.

Bar 160 is preferably a solid metal mass not only to electrically bridge the pairs of terminals but also to act as a heat sink for the switch. To rock such a metal mass, compression spring 90 is selected to have substantial enough compression strength. Actuation of the switch therefore involves enough force during depressing of a push surface 58A,58B to load spring 90. The sudden release of the stored energy provides a tactile and audible indication of completed switch actuation, especially when impactor 92 strikes bar 160.

The design of the terminals 104A,104B allows for large contact area with bar 160 as well as significant wiping action which removes surface oxides. The contact normal force is somewhat independent of the switch action which permits more freedom in selecting the design of the terminals to achieve the desired level of contact normal force. Large air gaps between the terminals is possible in the present invention.

A stamped and formed metal bar is also usable in the present invention, and since it is only necessary that each end of the bar electrically bridge the pair of contact sections at that end it is possible to use a bar which has conductive ends and may otherwise have a dielectric body joined to and between metal end sections, such as of a ceramic or plastic material which may also act as a heat sink. Other terminal designs are possible which provide contact sections biasable by the conductive bar ends to complete the circuit. The contact assembly also can be made in a somewhat different fashion such as by inserting the terminals into slots of a premolded dielectric holder and securing them therein. The type of pivotable actuator, the manner of asembling the switch, of securing the contact assembly in the housing, or of mounting the switch to a panel are modifications which do not depart from the spirit of the invention or the scope of the claims. Other modifications may be made which still result in a switch having an instantaneous breaking of the circuit between the first pair of terminals followed immediately by an instantaneous bridging of the second pair of terminals.

What is claimed is:

1. An electrical switch of the type having an actuator movable between a first position and a second position for moving a bridge member to electrically bridge a first pair of terminals or a second pair of terminals respectively, said terminals engageable with respective corresponding contact means, said switch comprising:

housing means having an actuating face and a contact face;

dielectric insert means mountable within said housing means proximate said contact face thereof;

a first pair of terminal means mounted to said dielectric insert means and having a spaced pair of first contact sections at a selected first location within said housing means after said insert means is mounted therein and further having outer first contact sections at said contact face for engagement with first corresponding contact means;

a second pair of terminal means mounted to said dielectric insert means and electrically insulated from said first pair of terminal means, and having a spaced pair of second contact sections at a selected second location within said housing means after said insert means is mounted therein, and further having outer second contact sections at said contact face for engagement with second corresponding contact means;

a bar having a first conductive end associated with said pair of first contact sections and a second conductive end associated with said pair of second contact sections;

mounting means for securing said bar to said dielectric insert means prior to mounting said dielectric insert means within said housing means such that said first end is proximate said pair of first contact sections and said second end is proximate said pair of second contact sections, said mounting means including a pivot means and permitting actuated movement of said bar about said pivot means between a first position and a second position;

actuating means secured to said housing means proximate said actuating face and movable between a first actuating position and a second actuating position, said actuating means including bearing means engageable with said bar at only a first engaging position proximate said first end thereof and a second engaging position proximate said second end thereof, said actuating means further including means for axially loading said bearing means;

biasing means for camming said bearing means away from loaded engagement with said bar at an initial one of said first and said second engaging positions, and permitting impacting of said bearing means into loaded engagement with said bar at a resulting one of said first and said second engaging positions, during movement of said actuating means between said first and said second positions; and holding means for holding said bar stationary at an initial one of said first and said second bridging positions such that a respective one of said first and said second ends thereof is held under substantial contact normal force in electrical engagement with a respective pair of said first and second contact sections;

said bar being movable by said actuating means to a first bridging position electrically bridging only said pair of first contact sections when said actuating means is in said first actuating position and to a second bridging position electrically bridging only said pair of second contact sections when said actuating means is in said second actuating position, and said bar being held in said initial one of said first and second bridging positions until being moved to a resulting one of said first and second bridging positions by being impacted by said bearing means proximate said resulting one of said first and said second engaging positions.

2. An electrical switch as set forth in claim 1 wherein each said terminal means includes a spring contact arm, a respective said contact section thereof is disposed on a free end thereof, and each of said first pair and said second pair of terminal means are disposed in said housing means such that the free ends of said spring contact arms of each pair are biasable away from each other by a respective said end of said bar being moved therebetween when said bar is urged into a respective bridging position, said free ends of said spring contact arms of each pair comprising said holding means capable of holding a respective said end of said bar under substantial contact normal force.

3. An electrical switch as set forth in claim 2 wherein said spring contact arm of each said terminal means comprises a doubled-back section thereof joined to a body section thereof by a bight, and said spring contact arm includes a recessed central section, and each of said first pair and said second pair of terminal means are disposed in said housing means such that the recessed central sections of said spring contact arms of each pair are spaced farther from each other than said free ends thereof, whereby a respective said end of said bar resides between said recessed central sections of a said pair of terminal means electrically unconnected with said pair when said bar is not in a respective bridging position.

4. An electrical switch as set forth in claim 1 wherein one of said first pair of terminal means and one of said second pair of terminal means are secured to a first contact insert of said dielectric insert means, the other of said first pair and the other of said second pair are secured to a second contact insert thereof, and said first and second contact inserts are securable together forming a contact assembly.

5. An electrical switch as set forth in claim 4 wherein said first and second contact inserts are molded to respective said ones and others of said terminal means.

6. An electrical switch as set forth in claim 4 wherein said first and second contact inserts are hermaphroditic and each has a securing projection and a projection-receiving hole respectively associated with the projection-receiving hole and the securing projection of the other, and each said securing projection is force-fitted into the corresponding projection-receiving hole.

7. An electrical switch as set forth in claim 4 wherein said first and second contact inserts each have an inner peaked section, and said inner peaked sections are joined to form a fulcrum when said first and second contact sections are secured together.

8. An electrical switch as set forth in claim 7 wherein said first and second contact inserts each have an outer peaked section located closer to said actuating face of said housing means than said inner peaked section of said contact insert, said outer peaked sections having aligned top surface means together comprising said biasing means for camming said bearing means of said actuator means.

9. An electrical switch as set forth in claim 8 wherein said outer peaked sections of said joined first and second contact inserts each have a central peak, said central peaks being aligned, and said outer peaked sections having first coplanar top surface portions sloping outward from said aligned central peaks and toward said first end of said bar and having second coplanar top surface portions sloping outward from said aligned central peaks and toward said second end of said bar, outer sections of said first and second top surface portions remote from said central peaks being farther from said bearing means than respective said first and second engaging positions of said bar and peak-proximate sections of said first and second top surface means being closer to said bearing means than the top surface of said bar and comprising said biasing means.

10. An electrical switch as set forth in claim 9 wherein said bearing means has a selected orientation and length such that said bearing means is engageable with and extends between said outer peaked sections of said joined first and second contact inserts and across said top surface of said bar.

11. An electrical switch as set forth in claim 9 wherein said top surface of said bar includes a shallow recess extending from near said first end thereof to near said second end thereof and including therein said first engaging position and said second engaging position at respective ends of said shallow recess.

12. An electrical switch as set forth in claim 11 wherein a boss extends from said central peak of said outer peaked section of each of said first and second contact inserts relatively toward the other thereof, said bosses are joined above and spaced from said fulcrum when said first and second contact inserts are secured together, and said bar is disposed between said fulcrum and said joined bosses and is pivotably held therebetween, with said joined bosses disposed in a pinning recess centrally of said top surface of said bar, and said first end of said bar is disposed proximate said first contact sections and said second end thereof is disposed proximate said second contact sections.

13. An electrical switch as set forth in claim 1 wherein said bar is a metallic article.

14. An electrical switch as set forth in claim 13 wherein said bar is a profiled solid metal mass, whereby said bar is also a heat sink.

15. An electrical switch as set forth in claim 1 wherein said actuating means includes an actuator member, a plunger member movable along an axis of movement towards and away from said actuator member, and a compression spring disposed between said actuator member and said plunger member and compressible along said axis, said bearing means being disposed on an end of said plunger member.

16. An electrical switch as set forth in claim 15 wherein said spring is disposed in a cavity of said plunger member and said plunger member is disposed movably within a cavity of said actuator member such that said bearing means is remote from said actuator member.

17. An electrical switch as set forth in claim 15 wherein said actuator member is pivotably mounted to said housing means about an axis of rotation proximate said actuating face of said housing means whereby said actuator member is pivotably movable to said first actuating position moving said bearing means to engage said bar at said first engaging position, and to said second actuating position moving said bearing means to engage said bar at said second engaging position, said axis of rotation being perpendicular to and spaced from said bar.

18. An electrical switch as set forth in claim 17 wherein said housing means has a pair of opposing spaced cylindrical bosses on interior side surfaces thereof and proximate said actuating face defining said axis of rotation and engageable by corresponding arcuate bearing surface means on corresponding sides of said actuator member upon said actuator member being secured in said housing means.

19. An electrical switch as set forth in claim 17 wherein said actuator member has first and second push surfaces accessible along said actuating face of said housing means.

20. An electrical switch as set forth in claim 19 wherein upper arcuate bearing surfaces are disposed on arcuate flanges proximate the top of said actuator member and lower arcuate bearing surfaces are disposed on free ends of latch arms extending toward said arcuate flanges from joints proximate the bottom of said actuator member, said latch arms being biasable inwardly by respective said cylindrical bosses of said housing means during insertion of said actuator member into said housing means, and resiling upon riding over said bosses.

21. A contact assembly for a switch comprising a dielectric body having a base, a spaced pair of first terminals mounted to said base and having opposed first contact sections, a spaced pair of second terminals having opposed second contact sections, and mounted to said base a distance from said pair of first terminals and a bar having a conductive first end associated with said first terminals and a conductive second end associated with said second terminals, said body having a fulcrum located centrally between said pairs of said first terminals and said second terminals and further having a pinning means above and associated with said fulcrum, a central section of said bar being pivotably pinned between said fulcrum and said pinning means and pivotable between a first position and a second position such that in said first position said first end electrically bridges said first contact sections and said second end is disengaged from said second contact sections, and in said second position said second end electrically bridges said second contact sections and said first end is disengaged from said first contact sections.

22. A contact assembly as set forth in claim 21 wherein said body includes a first section and a second section, each of said first and second sections having secured therein one of said pair of first terminals and one of said pair of second terminals and including a laterally directed fulcrum portion and a laterally directed boss portion above said fulcrum portion such that when said first and second sections are joined about said bar, said fulcrum portions are joined below said bar forming said fulcrum, and said boss portions are joined above said bar forming said pinning means.

23. A latching system for pivotably mounting a first member with a second member by insertion of a first end of said first member into a channel of said second member from a first face thereof, comprising an opposing pair of cylindrical bosses together defining an axis of rotation and disposed on opposing walls of one of said first member or said second member, and a pair of opposed arcuate bearing surfaces corresponding to each of said cylindrical bosses disposed on projections of corresponding walls of the other of said first member or said second member, wherein a first one of each said pair of opposed arcuate bearing surfaces is disposed inside an arcuate flange and a second one thereof is disposed on a concave free end of a latch arm extending toward said arcuate flange from a joint proximate an end of said other of said first member or said second member, each said latch arm being urgeable by a corresponding said boss laterally away from said boss during insertion of said first member into said second member and resiling after completion of said insertion such that said boss is disposed between said free end of said latch and said arcuate flange, whereupon both said bosses are disposed between respective said pairs of arcuate bearing surfaces and rotatable a selected angular distance therewithin latchably securing said first member within said second member and allowing pivoted relative movement therebetween about said axis of rotation.

* * * * *